US008825204B2

(12) United States Patent
Celeste et al.

(10) Patent No.: US 8,825,204 B2
(45) Date of Patent: Sep. 2, 2014

(54) METHOD AND CONTROL CIRCUIT FOR ADJUSTING A GAP

(75) Inventors: Ronald Celeste, Kuehlental (DE); Reinhard Seiler, Aindling (DE); Ulrich Miller, Tapfheim (DE)

(73) Assignee: Bowe Systec GmbH, Augsburg (DE)

( * ) Notice: Subject to any disclaimer, the term of this patent is extended or adjusted under 35 U.S.C. 154(b) by 1132 days.

(21) Appl. No.: 12/532,631

(22) PCT Filed: Apr. 7, 2008

(86) PCT No.: PCT/EP2008/002745

§ 371 (c)(1),
(2), (4) Date: Feb. 9, 2010

(87) PCT Pub. No.: WO2008/122433

PCT Pub. Date: Oct. 16, 2008

(65) Prior Publication Data

US 2010/0191368 A1 Jul. 29, 2010

(30) Foreign Application Priority Data

Apr. 5, 2007 (DE) ..... 10 2007 016 589

(51) Int. Cl.
*G06F 7/00* (2006.01)

(52) U.S. Cl.
USPC ..... 700/230

(58) Field of Classification Search
USPC ..... 700/230
See application file for complete search history.

(56) References Cited

U.S. PATENT DOCUMENTS

| | | | | |
|---|---|---|---|---|
| 4,605,217 | A * | 8/1986 | Goi | 271/124 |
| 5,203,846 | A | 4/1993 | Kuhns et al. | |
| 5,435,540 | A | 7/1995 | Martin et al. | |
| 5,676,365 | A | 10/1997 | Pittelkow et al. | |
| 5,871,433 | A * | 2/1999 | Lehmann et al. | 493/420 |
| 6,155,556 | A * | 12/2000 | Lynch et al. | 271/117 |
| 6,234,470 | B1 | 5/2001 | Okitsu et al. | |

FOREIGN PATENT DOCUMENTS

| | | | |
|---|---|---|---|
| DE | 2914097 | A1 | 10/1980 |
| DE | 29823055 | U1 | 5/1999 |
| EP | 0 949 171 | A1 | 10/1999 |
| JP | 09-175680 | | 8/1997 |
| WO | WO 98/04484 | A1 | 2/1998 |
| WO | WO 00/43671 | | 7/2000 |

OTHER PUBLICATIONS

English language translation of Official Action from Japanese Patent Office in counterpart Application No. 2010-501446 dated Feb. 29, 2012, 4 pages.
International PCT Report and Written Opinion, Nov. 29, 2009.
English language abstract of DE2914097, Oct. 16, 1980, 1 page.
English language translation of EP0017227 B1, European counterpart application of DE2914097, Nov. 11, 1982, 6 pages.
Partial English language translation of DE 29823055 U1, 7 pages.

(Continued)

*Primary Examiner* — Ramya Burgess
(74) *Attorney, Agent, or Firm* — Brill Law Office; Jeffrey Brill

(57) ABSTRACT

In a method for adjusting a gap through which a product is to be conveyed, a rotatable element is driven with a predetermined torque, and the rotatable element is moved against the product located in the gap until the rotatable element stops.

23 Claims, 12 Drawing Sheets

(56) References Cited

OTHER PUBLICATIONS

Official Action dated Jul. 1, 2013 from European Patent Office in counterpart application 08 735 065.8, 7 pages.
English language abstract of reference WO 98/04484 A1 cited in Official Action from EPO, 1 page.
English language translation of WO 98/04484 A1, Feb. 5, 1998, 4 pages.
English language translation of Official Action dated Jul. 1, 2013 from European Patent Office in counterpart application 08 735 065.8, 5 pages.

* cited by examiner

METHOD AND CONTROL CIRCUIT FOR ADJUSTING A GAP

BACKGROUND OF THE INVENTION

The invention relates to a method and control circuit for adjusting a gap, in particular a gap through which a product is conveyed.

Paper handling systems, such as enveloping systems, comprise applications in which, from a stack of products, e.g. sheets of paper or envelopes, one sheet or envelope each is provided for processing in the system. Such systems comprise, for example, supplement feeders or envelope feeders, but also folding units, to which products from a stack are provided individually or in groups from a stack.

SUMMARY

According to an embodiment, a method for adjusting a gap between a first material surface and a second material surface, through which a product is to be conveyed may have: (a) exerting a driving action working towards a relative motion between the first material surface and a product to be conveyed in the gap, such that the driving action leaves a gap width between the first material surface and the second material surface unchanged; (b) changing the gap width for determining at what gap width a retardation counteracting the relative motion between the first material surface and the product to be conveyed fulfills a predetermined condition; and (c) adjusting the gap width based on determining at what gap width the retardation fulfills the predetermined condition.

According to another embodiment, a method for adjusting a gap between a first material surface and a second material surface through which a product is to be conveyed may have: (a) providing a product to be conveyed, which is located in the gap between the first material surface and the second material surface, with a driving action working towards a relative motion between the first material surface and the product; and (b) changing the gap width, wherein the product to be conveyed is located in the gap, until a retardation counteracting a relative motion between the first material surface and the product fulfills a predetermined condition.

Another embodiment may have a computer program having a program code for performing the inventive methods when the program runs on a computer.

Another embodiment may have a control circuit for adjusting a gap between a first material surface and a second material surface through which a product is to be conveyed, wherein the control circuit is configured for performing an inventive method.

Another embodiment may have a paper-handling apparatus having an inventive control circuit.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
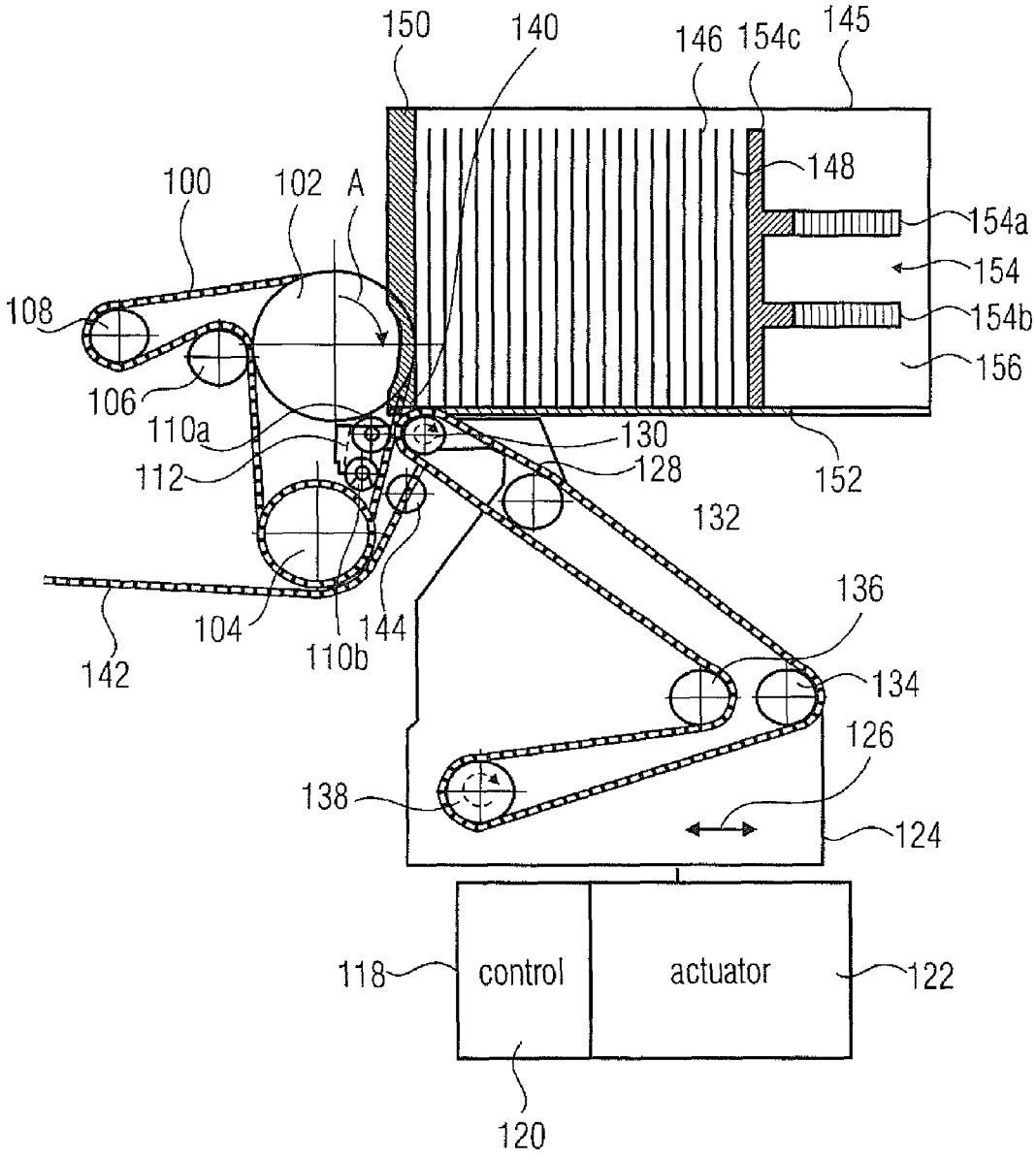
FIG. 1 is a schematical illustration of a supplement feeder.

In the following, based on the accompanying drawings, embodiments of the invention will be discussed, wherein similar or equal elements are provided with the same reference numbers in the drawings. Further, in the description, the term "plurality" is used, which means two or more.

FIG. 1 shows a supplement feeder comprising a conveyor belt 100 guided around a suction drum 102 as well as further guide rollers 104, 106 and 108. The conveyor belt 100 is driven in a conveying direction A. Further, two fixed lock rollers 110*a* and 110*b* are provided, which are arranged between the suction drum 102 and the guide roller 104 such that the conveyor belt 100 is also moved across the lock rollers. The lock rollers 110*a* and 110*b* are mounted to a holder 112.

The supplement feeder comprises a control 120 controlling the operation of the supplement feeder. The control 120 is connected to an actuator 122 for moving a chassis 124 as indicated by arrow 126. The lock reverse belt 128 is located in the chassis or carrier 124, which is guided across a plurality of guide rollers 130 to 138 and can be driven against the conveying direction A (in a clocked manner). As can be seen in FIG. 1, the chassis 124 and thus the reverse belt 128 are arranged such that the guide roller 130 is arranged opposite to the lock rollers 110*a* and 110*b* and opposite to the conveyor belt 100 across a hooked boss at the chassis 124. Here, a gap (also referred to as a lock gap) 140 is defined in an adjustable manner at this position by the spacing between the conveyor belt 100 or the lock rollers 110*a* and 110*b*, respectively, and the reverse belt 128. The actuator 122 effects lateral movement of the chassis 124 and thus of the reverse belt 128, whereby also the gap 140, i.e. the spacing between the rollers, can be adjusted.

Further, the supplement feeder comprises a deflector plate 142 as well as a reverse roller 144 for moving a product in a desired direction after separating.

Further, a product receptacle 145 for receiving a product stack 146, for example a sheet or paper stack, is provided, which is illustrated schematically in FIG. 1, from which the individual products 148 are withdrawn. The products 148 are arranged in the stack 146 in an upright manner (upright on one of the edges) and rest against a stop 150. The surface of the stop 150 facing the products 148 is flush with the belt 100 in a front area in the conveying direction A, wherein the suction drum and the conveyor belt 100 cooperate for sucking the foremost product of the stack 146 and moving the same in the conveying direction A. If the gap 140 is adjusted correctly, only a single product is passed. A product which is possibly withdrawn twice, i.e. a further withdrawn product, is retained due to the low width and the reverse belt 128 operating against the conveying direction.

Further, the product receptacle 145 comprises a guide element 152, extending towards the gap 140 through which the products are output. Apart from the shape shown in FIG. 1, the guide element 152, for example a guide plate, can also have other shapes. The guide element 152 can, for example, have a curve in the area of the gap 140 for guiding the products in the direction of the gap 140 and to the guide roller 130.

For supplying the products to the stop 150, the product receptacle 145 comprises a product transport 154 comprising two belts 154*a* and 154*b* arranged in parallel, which convey the introduced products upright in the direction of the stop 150. The product transport 154 further comprises a rear movable stop 154*c* holding the introduced products. The belts 154*a* and 154*b* are arranged in a bottom plate 156 of the product receptacle 145.

As has been described based on FIG. 1, a sheet feeder comprises a separation lock, comprising, for example, a first conveyor belt running around at least one suction drum for withdrawing individual products from a stack of products in the conveying direction. Further, a lock reverse belt is provided, which is driven in a direction opposite to the conveying direction of the products and cooperates with the conveyor belt for forming the separation lock. More exactly, the conveyor belt and the lock reverse belt are arranged to each other such that the lock gap is adjusted between the same. The spacing between the conveyor belt and the lock reverse belt is selected such that, when withdrawing a product from the product stack, merely the withdrawn product is moved through the lock gap. Further products that might also have been withdrawn will be held back.

Apart from the just described approach of a separation lock using conveyor belts, conveyor or reverse rollers, respectively, can also be used. The functionality is similar, both when using belts as well as when using rollers or a combination of roller and belt.

In conventional arrangements, a user will adjust the lock gap manually to a width suitable for the product to be processed prior to the start of separation. Here, it has to be ensured that the width is selected such that, on the one hand, double withdrawal, i.e. simultaneously withdrawal of two or more products, and, on the other hand, "non-withdrawal" of products is reliably avoided. The conveyor belts or the conveyor rollers are, for example, arranged in a fixed manner, whereas the reverse belts or the reverse rollers, respectively, are arranged in a movable (shiftable) manner in order to be able to adjust the lock gap to a width necessitated for the product to be processed by a respective shift of the reverse means. This adjustment necessitates at least the user input regarding the thickness of the product to be processed. Depending on this input, the lock gap will be adjust by shifting the reverse belt. Further, when adjusting the gap, the retention force of the product clamped between the conveying unit and the holding element has to be considered when conveying through the lock.

The lock adjustment or the adjustment of the withdrawal force (retention force of the product clamped between the conveying unit and the holding element during transport through the lock) is made manually based on the personal "feeling" or manually with a measurement or adjustment instrument, e.g. a spring balance. For allowing the withdrawal process, the lock adjustment is realized such that the withdrawal force is smaller than a possible withdrawal force. The manual adjustment described above does not allow a precise and reproducible lock adjustment.

It follows that there is a need for allowing a precise and reproducible lock adjustment with regard to the withdrawal force having a positive effect on the processing.

Embodiments of the present invention allow an adjustment of the lock withdrawal force independent of supplements and materials.

According to embodiments, the adjustment can be performed fully automatically without user intervention according to the following method. The supplement is fed into the feeder and to the lock. Then, the lock is opened, for example by moving the conveyor unit and the holding unit apart relative to each other. The supplement is introduced into the open lock and stopped in the lock. Then, according to an embodiment, the retention element, for example the reverse roller, is provided with a certain torque for driving the same against the conveying direction. The predetermined torque, with which the reverse roller has been provided, corresponds, for example, to the amount of the fed-in current in a flanged step motor. The applied torque is proportional to the introduced current and can also be adjusted correspondingly by the same. Then, the lock is closed, by automatically blocking the retention element, until the retention element stops due to the applied force. The applied force results from the friction force resulting from the applied normal force and the friction value on the supplement surface.

When the retention element stops due to the applied force, the lock can be closed even further. Alternatively, reducing the gap width can be stopped as soon as the retention element stops due to the applied force.

Thus, changing the gap width "until" a certain condition is fulfilled, means changing the gap width "at least until" the certain condition is fulfilled. This does not exclude changing the gap width any further, when the determined condition is fulfilled. However, there are several embodiments where changing the gap width is stopped when the condition is fulfilled.

Embodiments of the invention can realize closing the lock in small steps. According to further embodiments, the motor can be coupled to the rotational element via a mechanical gear, wherein the mechanical gear is dimensioned in dependence on a desired retention force in the gap for adjusting the predetermined torque.

Since in a constant driving torque defined by the introduced current, the counteracting force in the torque at the time of standstill is the same, the retention force applied in this method is also the same. The currently found lock adjustment corresponds to a withdrawal force proportional to the torque applied by the fed-in current.

This withdrawal force can be adjusted in the same manner by this method, independent of

- supplement thickness,
- surface structure,
- quality, and/or
- structure and quality of conveyor and retention elements or their state of contamination and wear and tear.

By this method, the withdrawal force can be adjusted independent of the material and in the same and constant manner to a measure below the withdrawal force. Since this value is significant and a characteristic element of reliable functionality, simple and reliable adjusting is possible by using the described method.

During production, the retention element is subject to constant wear and tear, so that the conditions in the lock gap and thus the withdrawal force change as well. Correcting these circumstances in the case of error, as well as compensating the wear and tear, which has so far only been performed manually when the need has arisen, is now possible in a fully automatic manner and in regular periods by the method according to embodiments of the invention.

It follows that embodiments of the invention allow the detection of wear and tear of the retention element, by determining the change of the lock gap (spacing between the conveyor element and the retention element), and also possibly by comparing the same to the measured thickness of the product. Periodically, using the method according to embodiments of the invention, the currently prevailing friction force (withdrawal force) can be determined. Possible deviations from a starting state can also be indicated, for example by the increased occurrence of erroneous or double withdrawals.

If deviations to the starting state are determined, correcting measures can be taken, for example, re-measuring the withdrawal force or the lock gap. Embodiments of the invention optimize the method, so that the same only necessitates approximately 25 seconds, whereby the correcting measures can also be performed periodically during running production.

Embodiments of the invention can be realized as a digital memory medium, for example a disc or file, comprising electronically readable control signals that can cooperate with a programmable computer system such that the method according to embodiments of the invention is performed. Further, the invention can be implemented as a computer program product with a program code for performing the method stored on a machine-readable carrier, when the program product runs on a computer. Also, the invention can be implemented in the form of a computer program with a program code for performing the method according to embodiments of the invention, when the program runs on a computer.

Figure 2A:
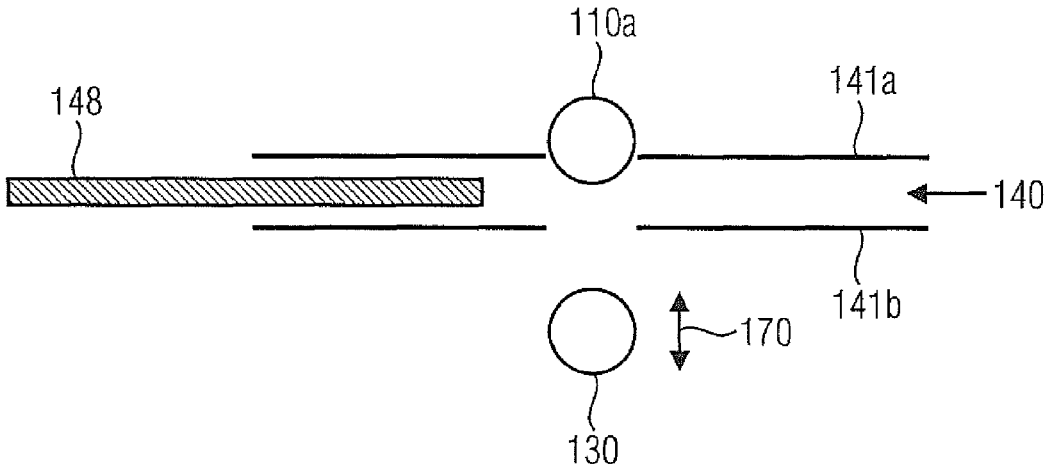
FIGS. 2A-2B is a schematical illustration of a method for adjusting the lock gap according to embodiments of the invention in a supplement feeder of FIG. 1.
Figure 2B:
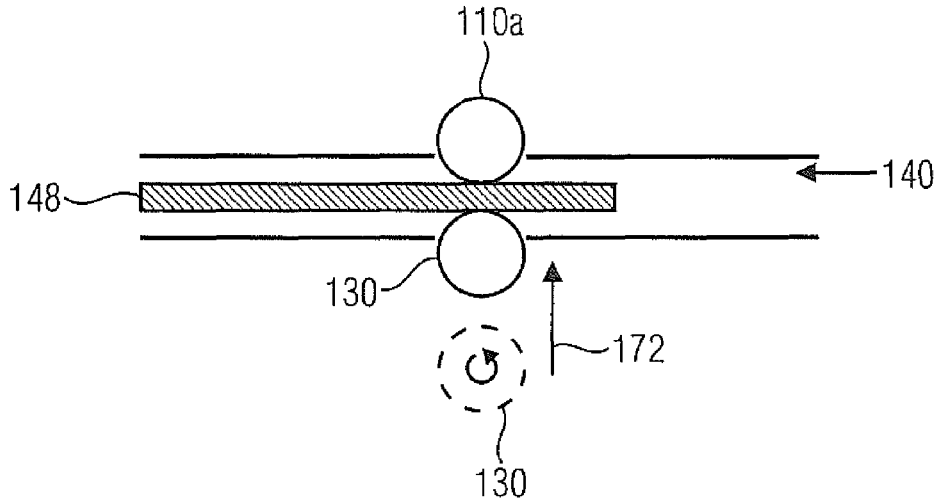

FIG. 2 shows a schematical illustration of a method for adjusting the lock gap according to an embodiment of the invention, in a feeder according to FIG. 1. FIG. 2A schematically shows the lock 140 with two parallel guide elements 141*a*, 141*b* (e.g. guide plates), the roller 110*a* as well as the reverse roller 130, wherein the same is arranged movably with regard to the roller 110*a* as is indicated by arrow 170. The rotatable element 130 is arranged movably, so that the same can be shifted such that it can extend through one of the guide elements 141*a*, 141*b* for contacting the product in the gap. Further, a product 148 is shown which is introduced into the opened gap 140 shown in FIG. 2A. FIG. 2B shows, in dotted lines, the driven roller 130, which is driven by a predetermined torque against the conveying direction, and, as shown by arrow 172, is moved in the direction of the product 148 now arranged in the lock, until the roller 130 stops.

In FIG. 2A, an operator applies, for example, a supplement for withdrawal, as is shown at 148. The same is, for example, held at the withdrawal flap by suction openings. By starting the method, the supplement 148 is moved into the lock 140 via a withdrawal mechanism. The reverse roller 130 is switched on with a predetermined current and the lock 140 closes simultaneously. For covering the large distance to the supplement as fast as possible, according to embodiments, the lock can be driven with its highest velocity. When the lock has reached the supplement, the reverse roller 130 is decelerated until it stops. This is detected by a rotary encoder on the reverse roller. The lock is then opened again in small steps until the reverse roller 130 starts moving again. The lock is closed again and the step size is again reduced. Prior to the last measurement, according to embodiments of the invention, the supplement can be stepped by a distance, for example several millimeters or centimeters, since the supplement has already been smoothed at the measurement position by the previous measurement. With rough supplements, this can lead to a too closely adjusted result. Further, possible unevenness or irregularities of the surface of the rotatable element 130 and/or abrasion of the product due to the initial conveying into the gap can thereby be taken into consideration. By the stepping, a new position of the supplement is reached. Now, in the last measurement step, the lock is opened with an even smaller step resolution. As soon as the reverse roller starts to rotate again, a desired lock opening is reached.

Figure 3:
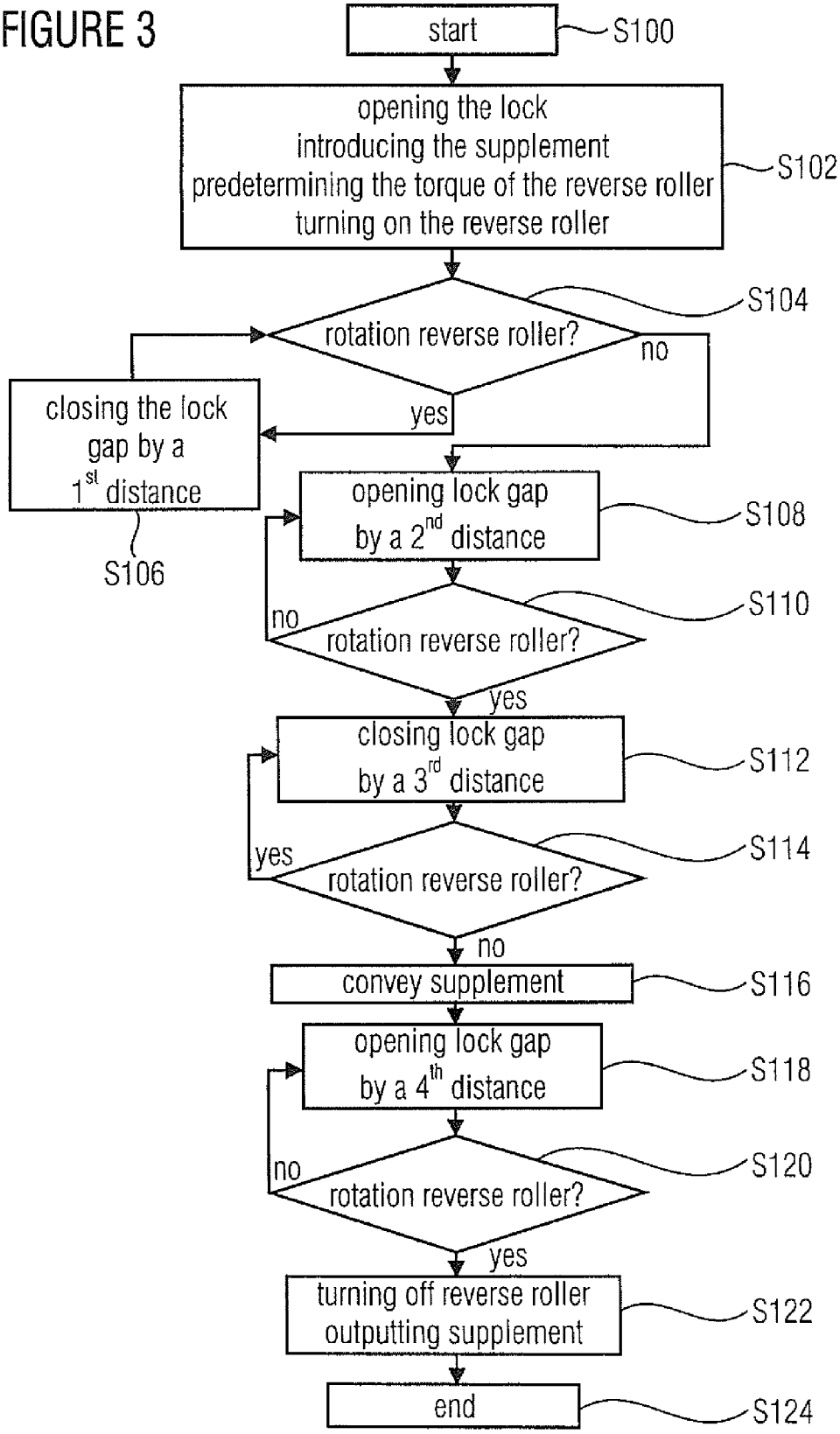
FIG. 3 is a flow diagram of the method for adjusting the lock gap according to a further embodiment.

The functionality just described will be discussed in more detail with reference to FIG. 3, which shows a flow diagram of an embodiment of the invention. In a first step S100, the method starts, which can be stored, for example, by respective programming, in the control (see FIG. 1) of the feeder. In a step S102, the lock is opened, the supplement is drawn in and the desired torque of the reverse roller is selected. Further, the reverse roller is turned on, and the current applied to a step motor is adjusted according to the desired torque. Now, in step S104, it is checked whether the reverse roller is still rotating. If this is the case, the lock gap is closed by a first distance (with a first step size) in step 106. Then, in step S104, the rotation of the reverse roller is again checked. As soon as the reverse roller is no longer rotating (i.e. the retardation fulfills, for example, a first predetermined condition), the method moves to step S108, wherein the lock gap is opened incrementally by a second distance smaller than the first distance (with a second step size smaller than the first step size) until the reverse roller rotates again (i.e. the retardation fulfills, for example, another predetermined condition), which is checked in step S110. When the reverse roller begins to rotate again, in step S112 the lock gap is closed by a third distance smaller than the second distance (with a third step size smaller than the second step size) until the reverse roller stops again, which is checked in step S114. Subsequently, the supplement is conveyed further by a predetermined distance in step S116, whereupon, in step S118, the lock gap is opened again by a fourth distance smaller than the third distance (with a fourth step size smaller than the third step size) until the reverse roller begins to rotate again, which is checked in step S120. When the reverse roller begins to rotate again, the same is turned off in step S122, and the supplement is output. The lock adjustment reached at this stage corresponds to the desired lock adjustment, and the method ends at step S124.

Here, it should be noted that the invention is not limited to the above-described embodiment. Embodiments can comprise only steps S104 and S106 for adjusting the gap. Other embodiments can comprise steps S104 to S110 or steps S104 to S114 for adjusting the gap.

According to embodiments, the product 148 can be moved in step S116 by a distance, which is selected such that an area of the product 148, which has not been in contact with the rotatable element 130 before, can be contacted with the rotatable element 130. According to embodiments, the product 148 can be moved, in step S116, by a distance between approximately 1 mm and the product length. The first step size in step S106 can be between approximately 125 mm and approximately 25 mm. The second step size in step S108 can be between approximately 10 mm and approximately 0.1 mm. The third step size in step S112 can be between approximately 0.1 mm and approximately 0.01 mm. The fourth step size in step S118 can be between approximately 0.01 mm and approximately 0.001 mm.

According to further embodiments, the second step size in step S108 can be approximately ⅕ to approximately 1/20 of the first step size, the third step size in step S112 can be approximately ⅕ to approximately 1/20 of the second step size, and the fourth step size in step S118 can be approximately ⅕ to approximately 1/20 of the third step size. Again, according to further embodiments, the second step size in step S108 can be approximately 1/10 of the first step size, the third step size in step S112 can be approximately 1/10 of the second step size, and the fourth step size in step S118 can be approximately 1/10 of the third step size.

According to embodiments, the rotatable element 110*a*, 130 can comprise a roller, a roll or a belt.

In the described embodiments, the gap between two conveyor elements of a conveyor mechanism for conveying products is formed in a guiding direction, wherein one of the conveyor elements can be driven with the predetermined torque, and wherein the driven conveyor element 130 is moved against the product located in the gap until the driven conveyor element 130 stops. One of the conveyor elements can be driven against the conveying direction. The conveyor elements of the conveyor mechanism for conveying products 148 in a conveying direction can comprise a pair of rollers, a pair of rolls, a pair of belts, a combination of roll and belt or a combination of roller and belt.

According to other embodiments, the rotatable element can be provided as additional element. The gap is defined by two elements movable relative to each other, e.g. by two non-rotatable elements such as guiding plates. Combinations of a non-rotatable element with a roller, a roll or a belt can also be used. Also, as described above, a pair of rollers, a pair of rolls or a pair of belts, a combination of roll and belt or a combination of roller and belt can be provided for defining the gap. Based on the position of the rotatable element at the end of the adjustment process, the relative shift of the two elements can be performed, for adjusting the gap corresponding to the desired retention force.

In the above-described manner, embodiments of the invention allow a fully automatic and, in particular, material-independent adjustment of the lock gap and the withdrawal force, also considering aspects of wear and tear of the conveyor elements. The described method can be performed when predetermined events occur, for example at periodic time periods or after detecting a certain error frequency, to allow for readjustment of the lock gap. By the above-described process, gap adjustment allowing reliable separation at all times is obtained.

The embodiments have been discussed in the context of a supplement feeder, but the invention is not limited to the usage in supplement feeders. Rather, the invention can be used at a plurality of positions within a paper-handling system. The adjustment of a gap, for example between two conveyor elements, can also be desirable at other stations, for example when adjusting a spacing between two conveyor rollers of a folding unit, in a sheet feeder or an envelope feeder.

According to an embodiment of the present invention, a method for adjusting a gap (or a lock gap, respectively) between a first material surface and a second material surface through which the product is to be conveyed comprises the following steps:

a) setting the first material surface in motion (by a driving action) such that the first material surface moves relative to the product such that a gap width between the first material surface and the second material surface remains unchanged; and b) reducing the gap width, wherein the product to be conveyed is located in the gap until retardation of the driving action fulfills a predetermined condition.

In the stated embodiment, the fact that friction between the product located in the gap and the first material surface depends on the gap width is utilized. The tighter the gap, the higher is a pressure acting on the product to be conveyed and the higher is a friction between the product to be conveyed and the first material surface. This friction counteracts the driving action applied to the first material surface so that effectively a retardation of the driving action results. Here, retardation of the driving action means an action counteracting the driving action, wherein it is not necessitated that the driving action has to be completely cancelled. Retardation of the driving action can be shown, for example, in that the first material surface with a predetermined driving force acting on the first material surface (or with a predetermined driving torque acting on the first material surface) is decelerated to a predetermined velocity (which can be higher than or equal to zero). Retardation of the driving action can also be shown, for example, in that, in a system where the velocity of movement of the first material surface is regulated such that the material surface moves with a predetermined minimum velocity, the force necessitated for driving the first material surface reaches a predetermined value. Thus, according to the described concept, it is determined generally (for example indirectly) how heavily the friction between the product to be conveyed and the first material surface counteracts the driving force (or driving action) acting on the first material surface.

In this regard, it should be noted that different arrangements exist for forming the gap. Some of these options will be described exemplarily below, wherein the following list of options is not to be seen as exhaustive but merely exemplary.

Figure 4A:
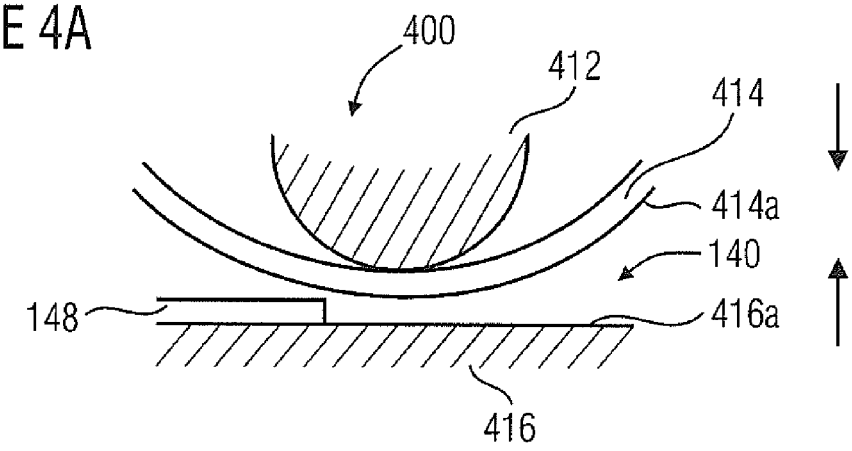
FIGS. 4*a*-4*f* is cross-sectional illustrations of arrangements for realizing the gap according to embodiments of the present invention.

FIG. 4*a* shows a cross-section of an arrangement for forming a gap according to an embodiment of the present invention. The arrangement according to FIG. 4*a* is indicated by 400 in its entirety and comprises a first guide element 412 serving as a guide for a belt or a band 414. Further, the arrangement 400 comprises a second guide element 416. Thus, the gap 140 exists between the belt or band 414 and the second guide element 416.

Further, it should be noted that a guide exists, so that the relative position of the first guide element 412 and the second guide element 416 to each other can be changed in order to be able to adjust the gap width of the gap. Further, an apparatus (e.g. a guide), which is not shown in detail, enables the introduction of the product to be conveyed into the gap.

In one embodiment, a lower surface 414*a* of the band or belt 414 forms the first material surface, while the upper surface 416*a* of the second guide element 416 forms the second material surface.

The guide element 412 does not necessarily have to be a pivotable device. Rather, a device mounted in a substantially rotationally stiff manner, for example a curved or bent guide plate, can also be used.

Further, it should be noted that the band or the belt 414 is driven by an appropriate driving means, which is not shown here, by using a driving action (for example by applying a force or a torque). For example, a step motor with adjustable torque can be used for driving the band or the belt 414.

Figure 4B:
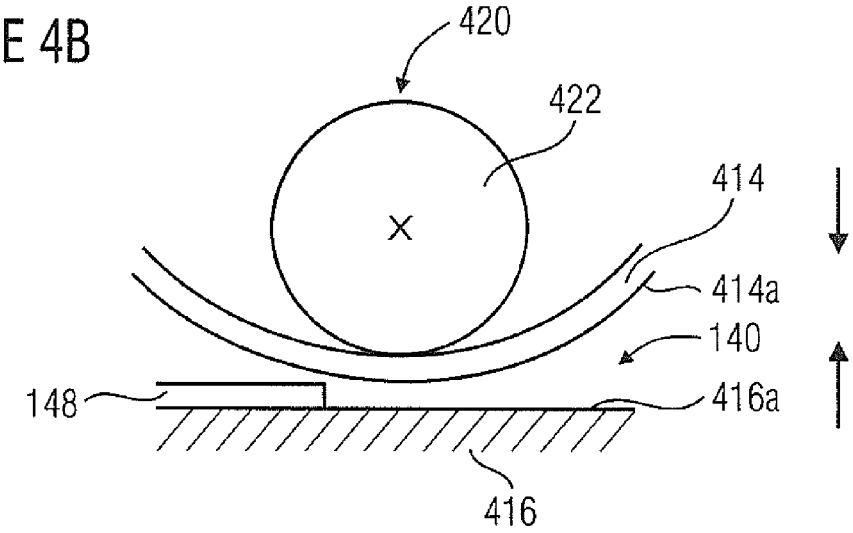

FIG. 4*b* shows a cross-section through a further arrangement for providing a gap. The arrangement according to FIG. 4*b* is indicated by 420 in its entirety. The arrangement 420 differs from the arrangement 400 according to FIG. 4*a* merely in that the guide element 412 is replaced by a guide roller 422. The guide roller 422 is pivotable. Further, in one embodiment the guide roller 422 is mounted such that the same is shiftable relative to the second guide element 416, so that the gap width of the gap 140 is adjustable. Further, the roller 422 can serve as a drive for the band or the belt 414, or merely form a passive (non-driven) guide roller.

Figure 4C:
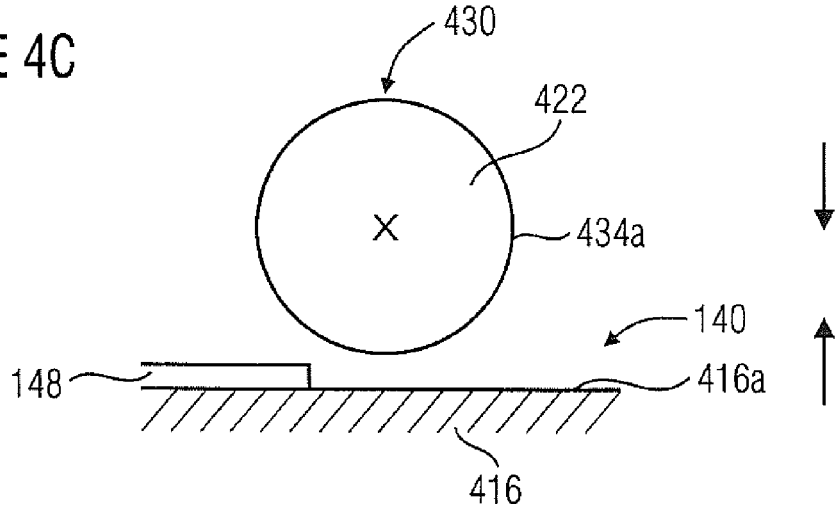

FIG. 4*c* shows a cross-sectional illustration of an arrangement for providing a gap according to a further embodiment of the present invention. The arrangement according to FIG. 4*c* is indicated by 430 in its entirety. The arrangement 430 corresponds essentially to the arrangement 420 according to FIG. 4*b*. However, in the embodiment according to FIG. 4*c*, the belt or band 414, respectively, has been omitted. Thus, the surface 434*a* of the roller 422 serves as the first material surface, while a surface 416*a* of the second guide element 416 serves as the second material surface.

The roller 422 is, for example, rotatably mounted and can be driven in one embodiment.

Figure 4D:
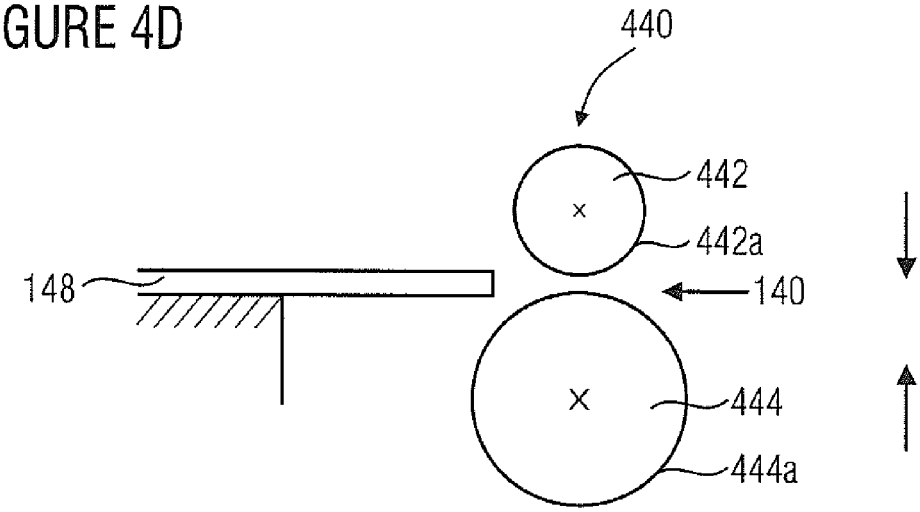

FIG. 4*d* shows a cross-sectional illustration of a further arrangement for realizing a gap according to a further embodiment of the present invention. The arrangement according to FIG. 4*d* is indicated by 440 in its entirety. The arrangement 440 comprises a first roller 442 as well as a second roller 444. Here, a surface 442*a* of the first roller 442 serves as the first material surface, while a surface 444*a* of the second roller 444 serves as the second material surface.

In one embodiment of the present invention, the first roller 442 is a driven roller, while the second roller 444 is a non-driven (passive) roller. In a further embodiment, the two rollers 442, 444 are driven. Further, it is not necessarily necessitated that both rollers 442, 444 are pivotable. Rather, it is sufficient when only one of the two rollers is pivotable.

However, in one embodiment of the present invention, the rollers 442, 444 are mounted such that a gap width between the surfaces 442*a*, 444*a*, through which the product can be conveyed, is adjustable. For adjusting the gap width, only one of the rollers can be movable or both rollers can be movable.

Figure 4E:
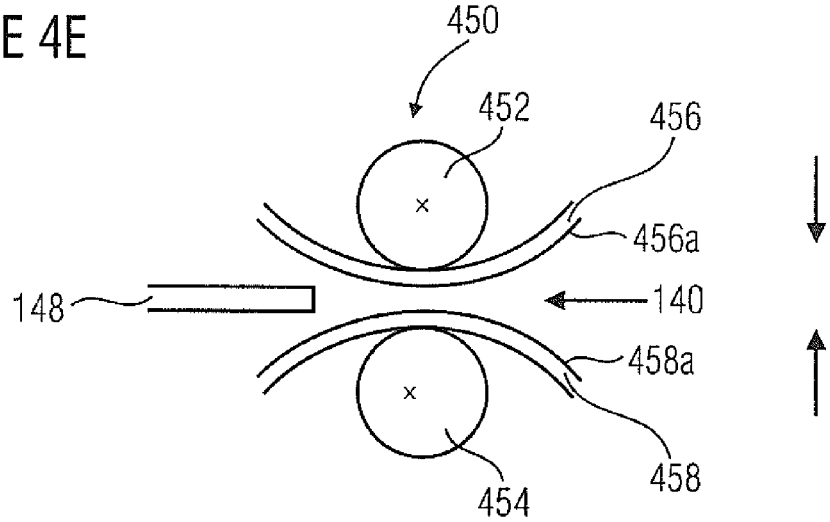

FIG. 4*e* shows a cross-sectional illustration of a further arrangement for realizing a gap. The arrangement according to FIG. 4*e* is indicated by 450 in its entirety. The arrangement 450 comprises, for example, two rollers 452, 454, both of which can be pivotable. A first band or a first belt 456 is guided across the first roller 452, and a second band or a second belt 458 is guided across the second roller 454. A surface 456*a* of the first belt 456 forms, for example, the first material surface, and a surface 458*a* of the second belt 458 forms, for example, the second material surface. It should be noted that the first belt 456 and/or the second belt 458 can be driven. Driving can be performed, for example, via rollers 452 and/or 454, or by further driving means, not shown here. Again, the rollers 452, 454 are arranged such that the gap width of the gap between the first surface 456*a* and the second surface 458*a* can be changed.

Figure 4F:
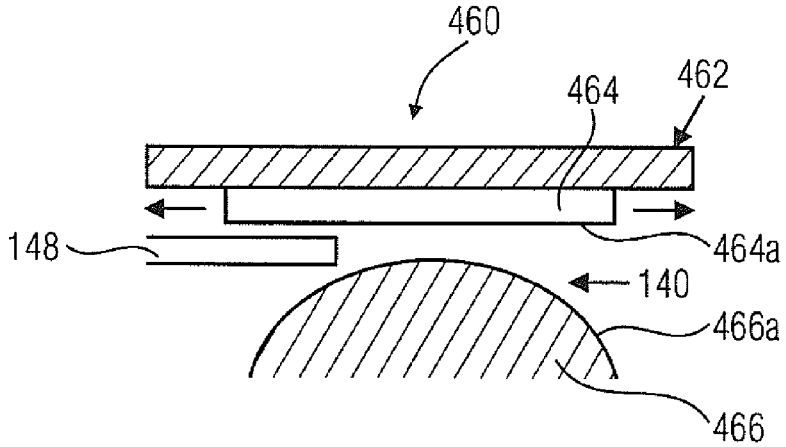

FIG. 4*f* shows a cross-sectional illustration of a further arrangement for realizing a gap according to a further embodiment. The arrangement according to FIG. 4*f* is indicated by 460 in its entirety. The arrangement 460 comprises a linear drive 462 having a driven member 464. A surface 464*a* of the driven member 464 can, for example, form the first material surface. Further, the arrangement 460 comprises a second guide element or a fixed member 466, whose surface 466*a* forms the second material surface. Thus, the gap 140 exists between the surface 464*a* of the driven member 464 and the surface 466*a* of the second guide element. The linear drive 462 can, for example, be implemented to drive the driven member 464 with a certain predeterminable force.

Further, it should be noted that it is not necessitated that the first surface of the gap 140 is formed immediately by a surface of the driven member 464. Rather, for example, a transfer means (for example a belt, a band, a gear or other mechanical transfer means) can be present for transferring the force provided by the linear drive 462 to a first material surface located within the area of the gap 140.

Thus, it can be generally said that two material surfaces are present in the area of the gap, at least one of which is drivable relative to the product to be conveyed or is driven during operation of the apparatus, respectively. However, it is possible that both surfaces, for example both the first material surface forming a first limitation of the gap and the second material surface forming a second limitation of the gap, are driven. The first material surface and the second material surface can, for example, be driven relative to the product in the same directions. Thereby, optionally, the same velocities or different velocities can be selected for the relative motion of the first material surface relative to the product or the relative motion of the second material surface relative to the product, respectively. Alternatively, the first surface and the second surface can also be driven in different or opposite directions relative to the product. Thereby, for example, an overall force on the product can be reduced.

Figure 5:
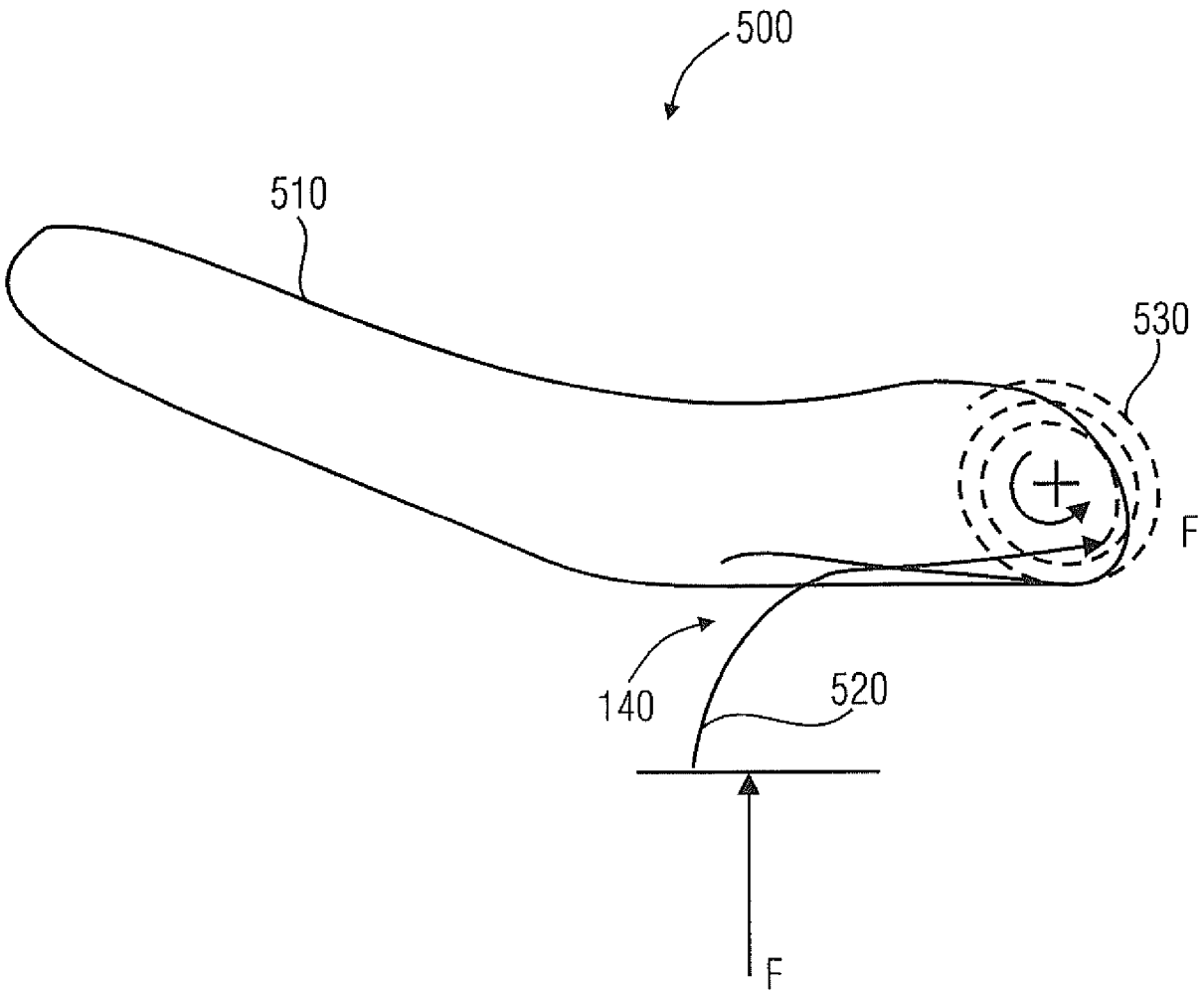
FIG. 5 is a schematical illustration of an inventive arrangement for realizing a gap according to a further embodiment.

FIG. 5 shows a cross-sectional illustration of an arrangement for realizing a gap according to a further embodiment of the present invention. The arrangement according to FIG. 5 is indicated by 500 in its entirety. The arrangement 500 comprises a belt or a band 510 as well as a metal sheet 520. The metal sheet 520 acts as a guide metal sheet for guiding the products to a gap between the metal sheet 520 and the band 510. The gap is indicated by 140.

The arrangement 500 further comprises a driving element 530, which is implemented for driving the band 510, for example by using a predetermined driving force or by using a predetermined driving torque. The driving element 530 can comprise, for example, a driven roller.

Further, the arrangement 500 comprises a means, which is implemented for moving the metal sheet 520 with a force F (that can differ from the force for driving the band 510) in the direction towards the band 510, or to press the same in the direction towards the band, respectively. Thus, by moving the metal sheet 520 towards the band 510, the width of the gap 140 is reduced.

In the following, based on FIGS. 6 and 7, two possibilities for adjusting an operating gap width will be described.

Figure 6:
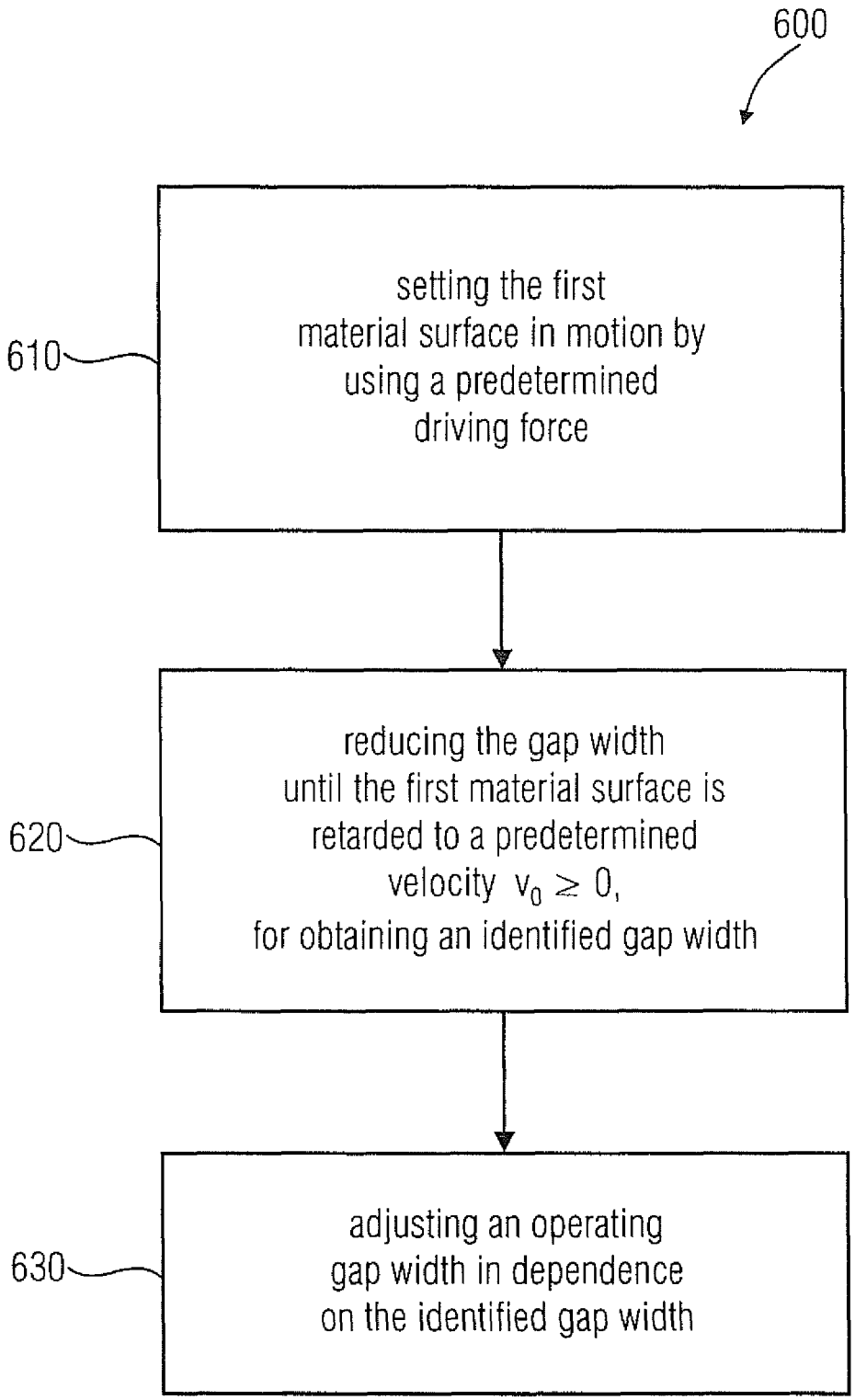
FIG. 6 is a flow diagram of a method for adjusting an operating gap width according to an embodiment of the present invention.

For that purpose, FIG. 6 shows a flow diagram of a method for adjusting the operating gap width according to an embodiment of the present invention. The method according to FIG. 6 is indicated by 600 in its entirety. The method 600 comprises a first step 610, wherein the first material surface is set in motion. Thereby, a predetermined driving force, which can also be defined by a predetermined driving torque, is used. Further, the method 600 comprises a second step 620 of reducing the gap width until the first material surface is decelerated to a predetermined velocity $v_0$. In other words, the gap width is reduced continuously or incrementally until the predetermined velocity is reached. The driving force or the driving torque, respectively, is maintained constant. The predetermined velocity can be selected higher than or equal to zero. If the predetermined velocity is selected equal to zero, this corresponds to completely blocking the movement of the first material surface. If it is detected that the first material surface has reached the predetermined velocity or has been decelerated to the predetermined velocity, a gap width associated with this state is identified. In a third step 630, an operating gap width is adjusted in dependence on the identified gap width. In this way, it can, for example, be determined that the operating gap width is higher than the identified gap width by a certain measure. Alternatively, the identified gap width can be directly used as the operating gap width if, for example, decelerating is not performed up to blocking, or when the predetermined driving force is significantly smaller than a driving force selected during operation. Additionally, alternatively, additional fine-tuning of the gap width can be performed.

Figure 7:
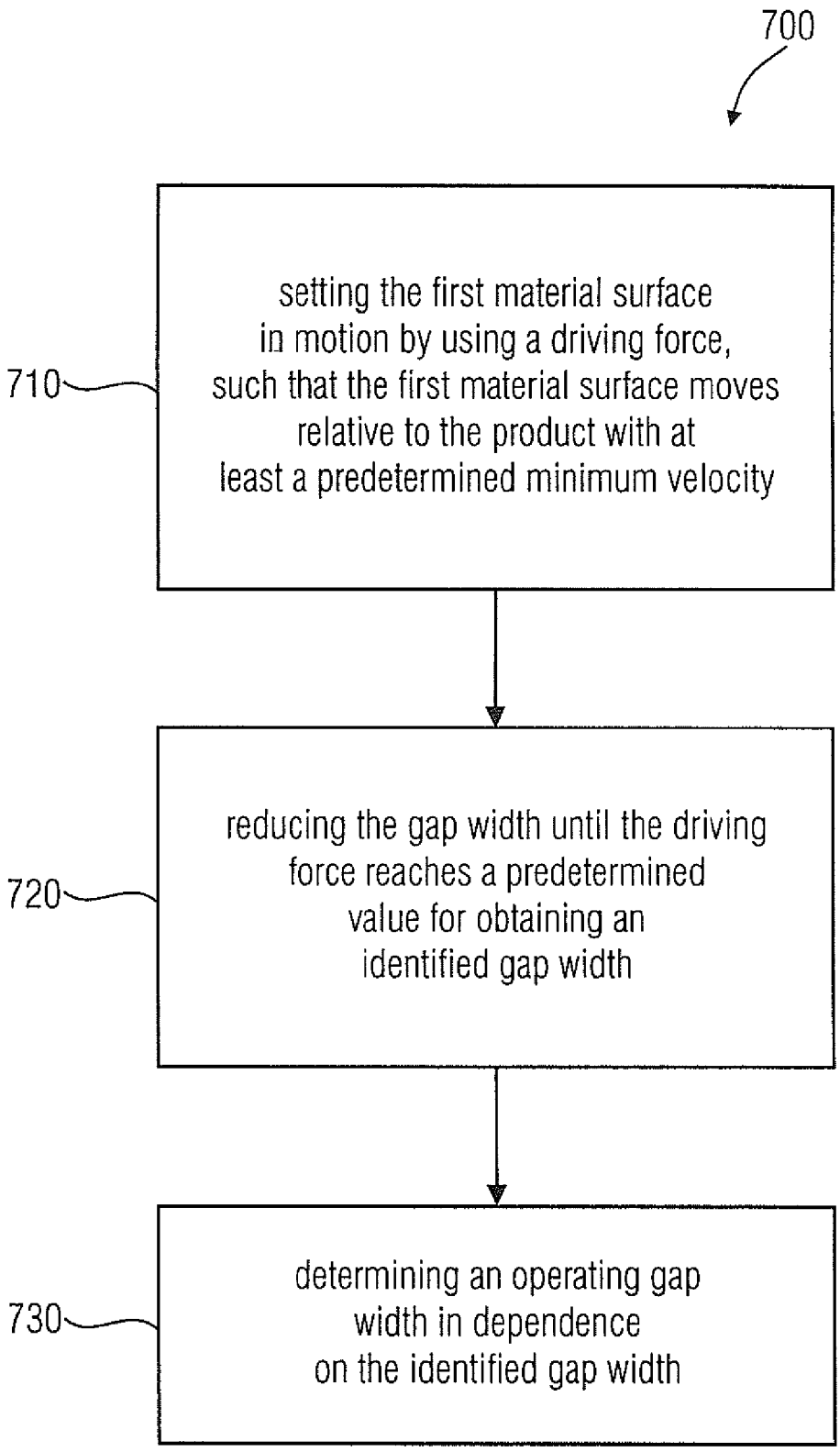
FIG. 7 is a flow diagram of a method for adjusting the operating gap width according to a further embodiment of the present invention.

FIG. 7 shows a flow diagram of a further method for adjusting an operating gap width according to a further embodiment of the present invention. The method according to FIG. 7 is indicated by 700 in its entirety. In a first step, the method 700 comprises setting the first material surface in motion. Therefore, for example, a driving force is used, and, further, the driving force is adjusted such that the first material surface moves with at least a predetermined minimum velocity with regard to the product. In other words, for example, velocity regulation can be performed, wherein the velocity of the first material surface is regulated. Here, for example, it can be assumed that the product is held.

In a second step 720, for example, the gap width is reduced until the driving force reaches a predetermined value. In other words, the narrower the gap width becomes, the higher the friction between the first material surface and the product becomes. Thus, the driving force necessitated for obtaining the predetermined minimum velocity becomes higher and higher. If the gap width reaches a predetermined value, the necessitated driving force will reach the predetermined value. Hence, the respective gap width is identified as identified gap width.

In a third step 730, the operating gap width is adjusted in dependence on the identified gap width. Thus, the operating gap width can, for example, be higher than the identified gap width by a predetermined value. Alternatively, the operating gap width can be selected equal to the identified gap width. Further, optionally, fine-tuning of the gap width can be performed.

Depending on the circumstances, the method of the invention can be implemented in hardware or in software. The implementation can be made on a digital memory medium, e.g. a disc or a CD, with electronically readable control signals that can cooperate with a programmable computer system such that the respective method is performed. Thus, generally, the invention also consists of a computer program product with a program code for performing the method according to embodiments of the invention stored on a machine-readable carrier, when the computer program product runs on a computer. In other words, the invention can thus be realized as a computer program with a program code for performing the method when the computer program runs on a computer.

In the following, several further embodiments will be described, which refer to different aspects according to the invention.

Figure 8:
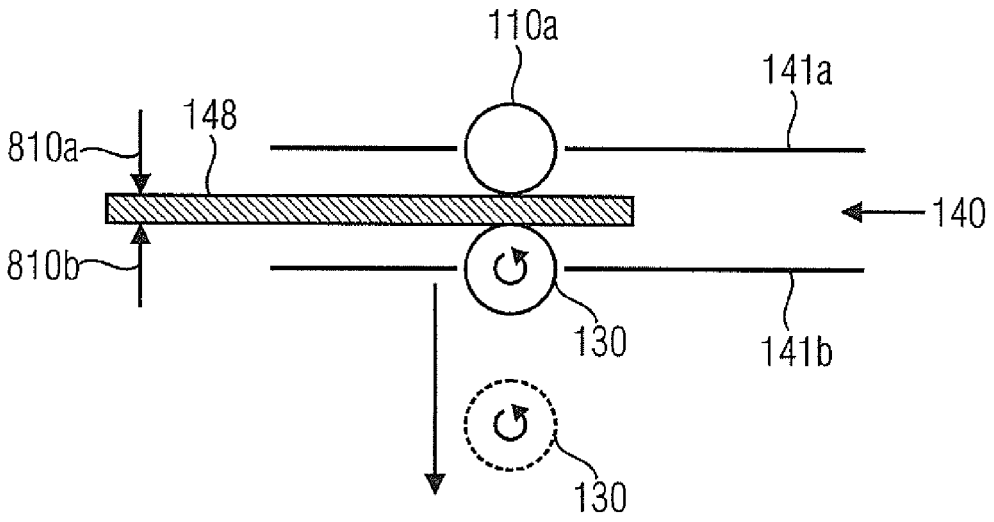
FIG. 8 is a schematical illustration of a method for adjusting the lock gap according to embodiments of the invention.

FIG. 8 shows a schematical illustration of a method for adjusting the lock gap according to embodiments of the invention. The method according to FIG. 8 differs from the method as described with regard to FIGS. 2A and 2B, mainly in that the reverse roller 130 is moved away from the product 148 during the process, so that when performing the process a gap width between the roller 110*a* and the reverse roller 130 is increased.

The product 140 can be held, for example, by holding elements illustrated schematically in FIG. 8 and indicated by 810*a*, 810*b*. A gap width between the roller 110*a* and the reverse roller 130 can, for example, be reduced in a starting state so far that a strong static friction exists between the reverse roller 130 and the surface of the product 148. The reverse roller 130 can be provided, for example, with a driving action causing a rotation of the reverse roller 130. Generally, the driving action can act towards the movement of the surface of the reverse roller 130 tangential to the gap, so that the driving force leaves the gap width unchanged. In this simple case, for example, a torque can act on the reverse roller 130.

If the gap width between the roller 110*a* and the reverse roller 130 in the starting state is comparatively small, the static friction between the surface of the product 148 and the reverse roller 130 can have the effect that the reverse roller 130 does not rotate despite the force of the driving action (or the driving torque). It follows that the movement of the surface of the reverse roller 130 relative to the product 148 is retarded by static friction.

Starting from this starting state, using the method, for example the gap width between the roller 110*a* and the reverse roller 130 is increased. Thereby, the reverse roller 130 is still provided with the driving action, e.g. in the form of an acting torque. If the gap width is increased sufficiently, the static friction between the surface of the product 148 and the reverse roller 130 decreases until the reverse roller 130, for example due to the driving action acting on the same, starts moving at a certain gap width.

Thus, from that point onwards, it can be assumed that at the gap width where the reverse roller 130 starts moving, the friction force applied to the reverse roller by the surface of the product 148 is smaller than the driving action acting on the reverse roller 130. Thus, overall, it can be determined when a retardation of the driving action (for example a friction force exerted on the reverse roller 130 by the surface of the product 148) achieves a predetermined value or falls below the same.

Based on the observation at what gap width between the roller 110*a* and the reverse roller 130 the stated retardation reaches a predetermined value or falls below the same, the gap width can be adjusted. For example, the gap width where the reverse roller 130 just starts to move can be used as the desired lock adjustment. However, the desired lock adjustment starting from the amount of the gap width where the reverse roller just starts moving can also be adjusted, e.g. a certain change of the gap width can be performed. Further, based on the determination at what gap width the reverse roller 130 starts moving, a multi-stage method for adjusting the gap width can be initialized, as has already been described, for example, based on FIG. 3.

Figure 9:
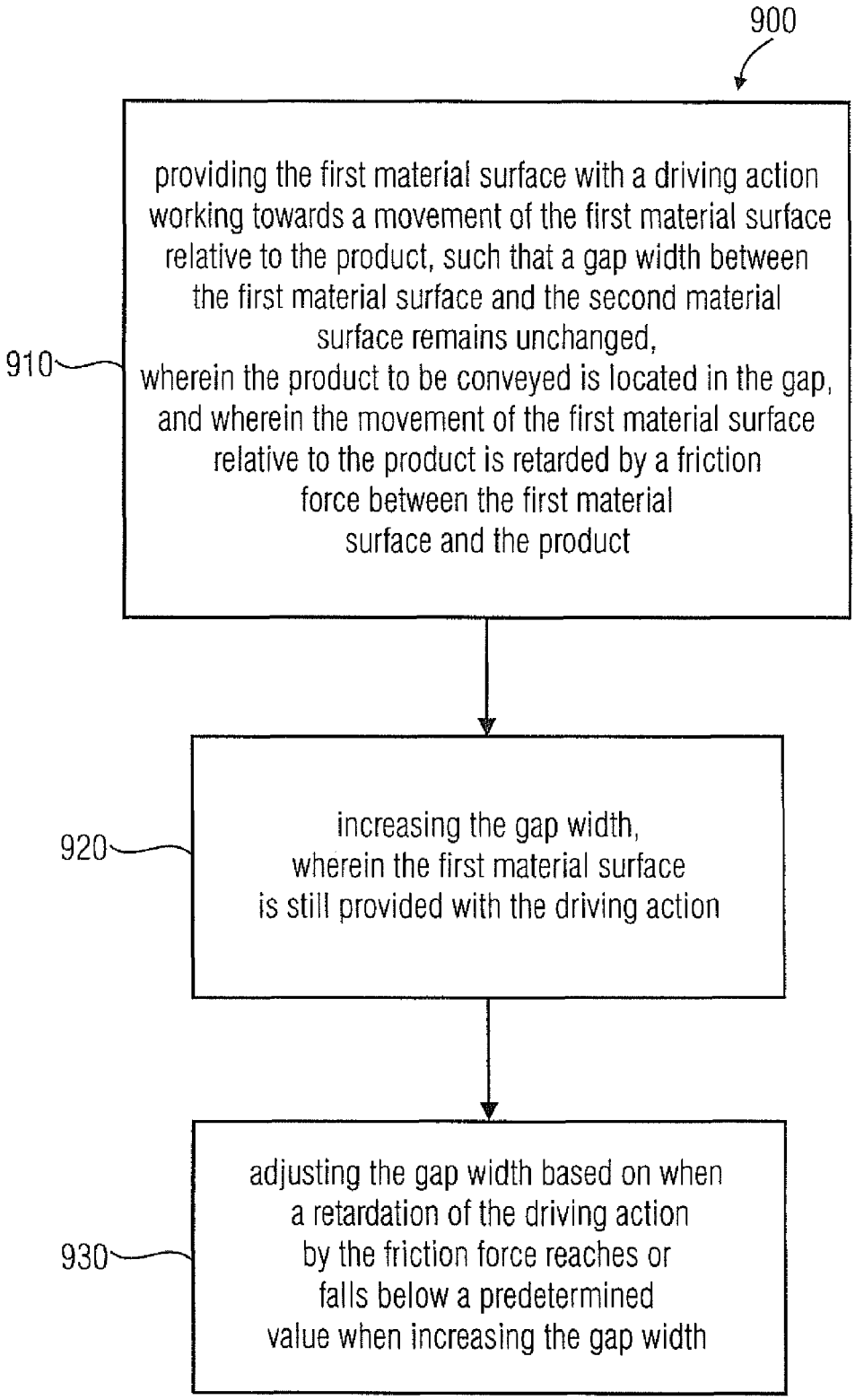
FIG. 9 is a flow diagram of a method for adjusting the lock gap according to an embodiment of the invention.

Generally, it can be said that the present invention according to one aspect comprises a method for adjusting a gap between a first material surface and a second material surface, through which a product is to be conveyed, according to FIG. 9.

The method according to FIG. 9 is indicated by 900 in its entirety. In a first step 910, the method 900 comprises providing the first material surface with a driving action working towards a movement of the first material surface relative to the product, such that the driving action leaves a gap width between the first material surface and the second material surface unchanged. The reverse roller 130 can be provided, for example, with a torque. Alternatively, it is possible to provide one of the movable areas shown with regard to FIGS. 4A to 4F with a driving action.

The product to be conveyed is located in the gap. Further, in step 910, for example the movement of the first material surface relative to the product is retarded by a friction force between the first material surface and the product.

In a step 920, for example, the gap width is increased, wherein the first material surface is still provided with the driving action.

In a step 930, for example, the gap width is adjusted based on when (for example at what gap width) a retardation of the driving action reaches a predetermined value or falls below the same due to the friction force when increasing the gap width (or, more generally, when the retardation of the driving force fulfills a predetermined condition).

As an alternative to steps 920, 930, for example, the gap width can be increased, wherein the first material surface is still provided with the driving action until a retardation of the driving action due to the friction force when increasing the gap width fulfills a predetermined condition.

In the following, based on FIG. 10, a further embodiment of a concept for adjusting the gap width will be described.

Figure 10:
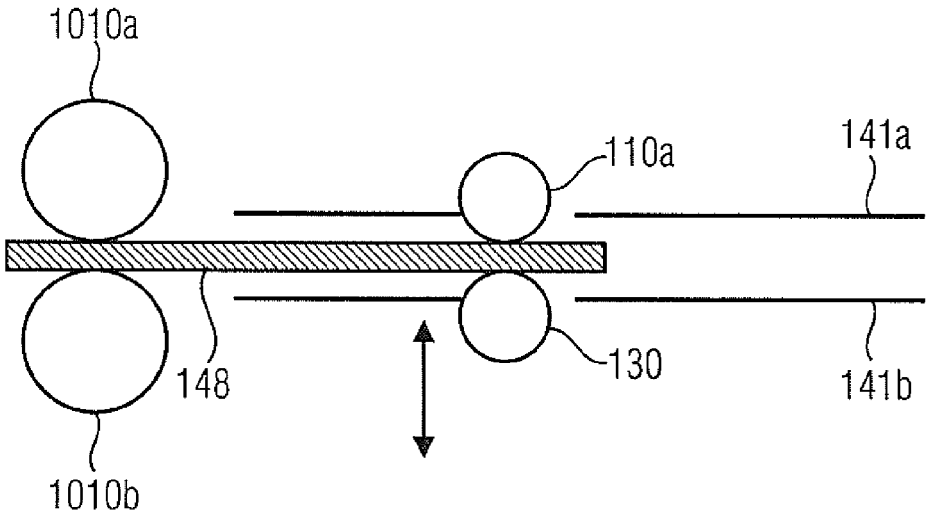
FIG. 10 is a schematical illustration of a method for adjusting the lock gap according to embodiments of the invention.

As can be seen from FIG. 10, the product 148, in addition to being in contact with the roller 110*a* and the reverse roller 130, can be provided with a driving action. This driving action can be provided to the product 148, for example by further rollers 1010*a*; 1010*b*. Generally, in this case, the gap between the reverse roller 130 and the roller 110*a* can be adjusted as follows:

The product 148, which is located in the gap between the roller 110*a* and the reverse roller 130, can be provided, for example by the further rollers 1010*a*, 1010*b*, with a driving action working towards a relative motion between the surface of the reverse roller 130 and the product. The reverse roller 130 can (for example by a respectively controlled motor, by a brake or by another means) be provided with a holding action, which counteracts a rotation of the reverse roller 130. Further, the gap width between the roller 110*a* and the reverse roller 130 can be changed, the product 148 to be conveyed being in the gap, in order to determine at what gap width a retardation counteracting a relative motion between the surface of the reverse roller 130 and the product 148 fulfills a predetermined condition. Further, generally, the gap width can be adjusted based on at what gap width the retardation fulfills the predetermined condition.

In detail, different options are possible.

1. The holding action acting on the reverse roller 130 is "weaker" than the driving action acting on the product 148:
   a) If a gap width between the roller 110*a* and the reverse roller 130 is small to begin with, in the stated case the reverse roller 130 will first rotate together with the movement of the product 148. Then, if the gap width is made larger, at some stage, starting from a certain amount of the gap width, no sufficient friction force will be exerted from the surface of the product 148 to the reverse roller 130 for overcoming the holding action acting on the reverse roller 130. Thus, starting from a certain gap width, the reverse roller 130 will come to a stop.
   b) If in the stated case, starting from a large gap width, the gap width is increasingly reduced, the friction force between the surface of the product 148 and the surface of the reverse roller 130 will continuously increase, so that the reverse roller 130, originally stationary due to the holding action, will start moving (starting from a certain gap width). This is caused by the fact that the surface of the product 148 exerts sufficient force to the surface of the reverse roller 130 when a certain gap width is reached.
2. The holding action acting on the reverse roller 130 is stronger than the driving action acting on the product 148:
   a) If the gap width between the roller 110*a* and the reverse roller 130, for example starting from a large gap width, is increasingly reduced, the product 148 will be increasingly decelerated with increasing friction force between the surface of the product 148 and the reverse roller 130 kept stationary by the holding action and will eventually stop (starting from a certain gap width).
   b) If, however, the gap width is continuously increased starting from a small gap width, the product 148 will at first be stationary due to the holding action exerted by the reverse roller and will start moving at some stage (starting from a certain gap width). The product 148 will start moving when the friction force between the surface of the product 148 and the reverse roller 130 becomes smaller than the driving action exerted, for example by the rollers 110*a*, 110*b*, to the product.

In several embodiments, the product 148 can be driven with a predetermined driving action. For example, one of the rollers 1010*a*, 1010*b* (or both rollers) can be driven with a predetermined torque. If the product 148 is driven with a predetermined torque and, further, the spacing between the roller 110*a* and the reverse roller 130 is increasingly reduced, the product 148 will stop in one embodiment from a certain gap width onwards. If it is assumed that the rollers 1010*a*, 1010*b* are applied sufficiently firmly to the product 148, the rollers 110*a*, 110*b* will stop correspondingly, which can be evaluated, for example, by a simple velocity sensor connected to one of the rollers 1010*a*, 1010*b*. Then, based on determining at what gap width the product or the rotation of one of the rollers 1010*a*, 1010*b* is decelerated in a predetermined manner (for example up to a predetermined velocity or up to standstill), an operating gap width can be adjusted.

In several embodiments, it is particularly advantageous when the product 148 moves between the roller 110*a* and the reverse roller 130 while the gap width is reduced. Thereby, it can be avoided that a certain surface area of the product 148 is particularly flattened. Thus, in several embodiments, very precise adjustment of the gap width (partly even in a single-stage method) is possible.

Figure 11:
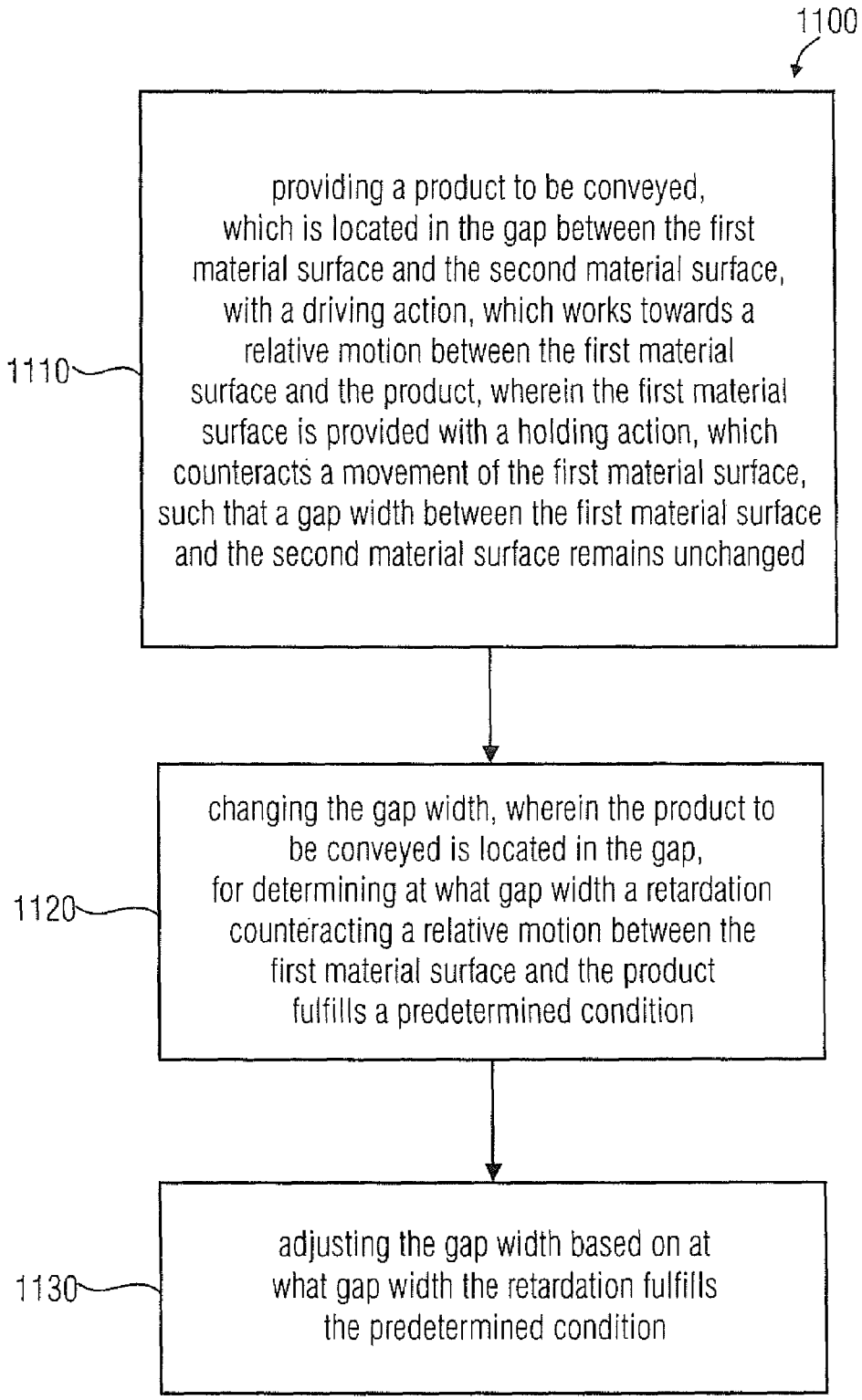
FIG. 11 is a flow diagram of a method for adjusting the lock gap according to an embodiment of the invention.

Generally, several embodiments according to the invention comprise a method as shown in the flow diagram of FIG. 11.

FIG. 11 shows a method 1100 for adjusting a gap between a first material surface and a second material surface through which a product is to be conveyed. The method 1100 comprises, in a step 1110, providing a product to be conveyed, which is located in the gap between the first material surface and the second material surface, with a driving action working towards a relative motion between the first material surface and the product. In step 1110, the first material surface is provided with a holding action counteracting a movement of the first material surface such that the gap width between the first material surface and the second material surface remains unchanged. In a step 1120, the method 1100 comprises changing the gap width, the product to be conveyed being located in the gap, for determining at what gap width a retardation counteracting a relative motion between the first material surface and the product fulfills a predetermined condition. In step 1120, for example, the first material surface can still be provided with a holding action. In step 1130, the method 1100 comprises adjusting the gap width based on at what gap width the retardation reaches the predetermined condition.

In several alternative embodiments providing the first material surface with a holding action counteracting a movement of the first material surface can be omitted. For example, the first material surface can be driven when the method 1100 is performed.

In several embodiments, the first material surface can be a stationary surface that is mounted, for example, in a rotationally stiff manner.

Regarding the above-mentioned embodiments, it is obvious that several embodiments according to the invention generally realize a method, which will be illustrated below based on FIG. 12.

Figure 12:
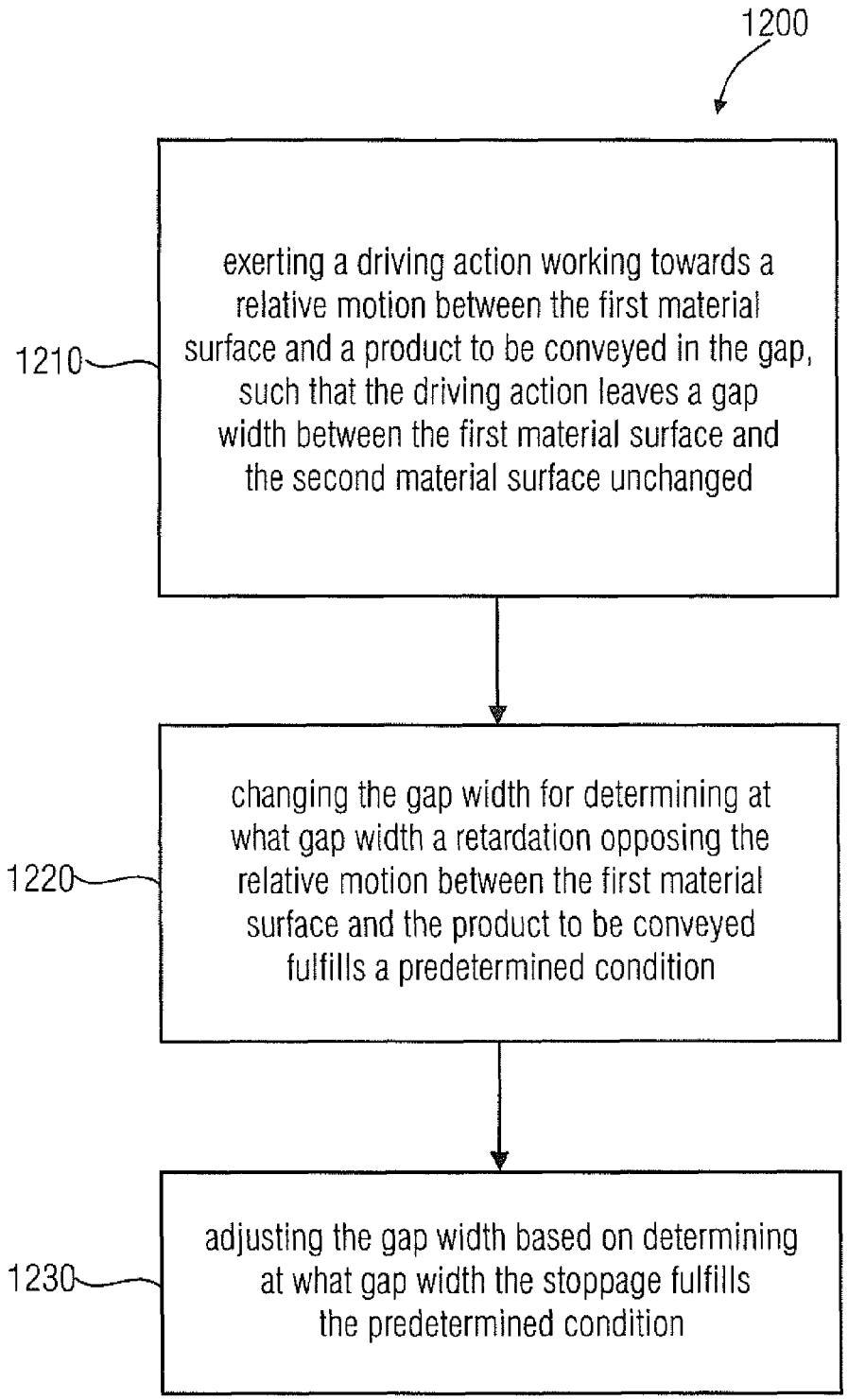
FIG. 12 is a flow diagram of a method for adjusting the lock gap according to an embodiment of the invention.

FIG. 12 shows a flow diagram of a method for adjusting a gap between a first material surface and a second material surface through which the product is to be conveyed. In a step 1210, the method 1200 according to FIG. 12 comprises exerting a driving action working towards a relative motion between the first material surface and a product to be conveyed in the gap, such that the driving action leaves a gap width between the first material surface and the second material surface unchanged. In a step 1220, the method 1200 comprises changing the gap width for determining at what gap width a retardation counteracting the relative motion between the first material surface and the product to be conveyed fulfills a predetermined condition. Further, in a step 1230, the method 1200 comprises adjusting the gap width based on the determination at what gap width the retardation fulfills the predetermined condition.

Further, it should be noted that the embodiments discussed based on FIGS. 8 to 12 can be supplemented by all those features and functionalities that have been discussed based on FIGS. 1 to 7.

Further, several embodiments according to the invention provide a control circuit for adjusting a gap between a first material surface and a second material surface through which a product is to be conveyed, wherein the control circuit can be implemented, for example, for realizing the methods as described herein.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. A method for adjusting a gap between a first material surface and a second material surface, through which a product is to be conveyed, the method comprising:

(a) exerting a driving action working towards a relative motion between the first material surface and the product to be conveyed in the gap, such that the driving action leaves a gap width between the first material surface and the second material surface unchanged;

(b) determining at which gap width a retardation counteracting the relative motion between the first material surface and the product to be conveyed fulfills a predetermined condition; and (c) adjusting the gap width to the determined width at which the retardation fulfills the predetermined condition.

2. A method for adjusting a gap between a first material surface and a second material surface, through which a product is to be conveyed, the method comprising:

(a) providing the product to be conveyed, the product being located in the gap between the first material surface and the second material surface, with a driving action working towards a relative motion between the first material surface and the product; and (b) changing the gap width, wherein the product is located in the gap, until a retardation counteracting a relative motion between the first material surface and the product fulfills a predetermined condition.

3. The method according to claim 2, wherein the first material surface is positioned according to one from a group of positions consisting of: i) stationary along a conveying direction, ii) fixed in a non-shiftable manner along the conveying direction, iii) movable along the conveying direction, and iv) driven along the conveying direction.

4. The method according to claim 2, further comprising determining at what gap width the retardation fulfills the predetermined condition by performing a step from a group of steps consisting of:

determining at what gap width a braking action fulfills the predetermined condition, wherein the breaking action is exerted by the first material surface on the product or on a driving element that imparts the driving action on the product;

determining at what gap width a movement of the product or the driving element is stopped;

determining at what gap width the product or the driving device starts moving;

determining at what gap width a driving action imparted from the product to the first surface fulfills the predetermined condition;

determining at what gap width the first surface starts moving by imparting a force from the product to the first surface; and, determining at what gap width the first surface stops.

5. The method according to claim 2, wherein changing the gap width further comprises performing a step from a group of steps consisting of:

reducing the gap width; and increasing the gap width.

6. The method according to claim 2, wherein:

step (a) further comprises providing the first material surface with a driving action working towards a movement of the first material surface relative to the product, such that the driving action leaves the gap width between the first material surface and the second material surface unchanged, wherein the product to be conveyed is located in the gap, and wherein the movement of the first material surface relative to the product is retarded by a friction force between the first material surface and the product; and step (b) further comprises increasing the gap width, wherein the first material surface is provided with the driving action until a retardation of the driving action fulfills the predetermined condition, wherein the retardation is due to the friction force when increasing the gap width.

7. The method according to claim 2, wherein:

step (a) further comprises setting the first material surface in motion by a driving action, such that the first material surface moves relative to the product such that the gap width between the first material surface and the second material surface remains unchanged; and step (b) further comprises reducing the gap width until a retardation of the driving action fulfills the predetermined condition, wherein the product to be conveyed is located in the gap.

8. The method according to claim 7, wherein setting the material surface in motion further comprises driving a rotatable element with a predetermined torque.

9. The method according to claim 5, wherein reducing the gap width further comprises moving the rotatable element against the product located in the gap until the rotatable element stops.

10. The method according to claim 7, wherein step (b) further comprises:

(b.1) incrementally reducing the gap width by using a first step size until the retardation fulfills the predetermined condition;

(b.2) incrementally increasing the gap width by using a second step size, which is smaller than the first step size, until the retardation fulfills a further predetermined condition;

(b.3) incrementally reducing the gap width by using a third step size, which is smaller than the second step size, until the retardation fulfills a further predetermined condition;

(b.4) moving the product by a predetermined distance; and (b.5) incrementally increasing the gap width by using a fourth step size, which is smaller than the third step size, until the retardation fulfills a further predetermined condition.

11. The method according to claim 10 further comprising: moving the product a distance such that an area of the product, which has not previously been in contact with the first material surface, can be contacted with the first material surface.

12. The method according to claim 1, wherein step (a) further comprises i) applying a predetermined energy to a motor of a driving element thereby achieving the driving action, wherein the predetermined energy is selected in dependence on a desired retention force in the gap for adjusting a predetermined torque, and ii) adjusting a current applied to the motor in dependence on the desired retention force.

13. The method according to claim 1, further comprising performing the following steps prior to performing step (a):

applying a product to the gap;

opening the gap;

introducing the product into the gap; and stopping the product in the gap.

14. The method according to claim 7, wherein steps (a) and (b) are repeated in response to occurrence of at least one predetermined event, wherein the at least predetermined event is selected from a group of predetermined events consisting of: an occurrence of a predetermined time, an occurrence of a specific time period after adjustment of the gap, a predetermined number of products having been conveyed and the occurrence of at least one predetermined error.

15. The method according to claim 7 further comprising: forming the gap between two conveyor elements of a conveyor mechanism for conveying products in a specific direction.

16. The method according to claim 15, wherein one of the conveyor elements comprises a rotatable element with a predetermined torque, wherein step (a) further comprises driving one of the conveyor elements with the predetermined torque, and wherein step (b) further comprises closing the gap until the driven conveyor element stops, wherein one of the conveyor elements is driven against the conveying direction, and wherein the conveyor elements of the conveyor mechanism for conveying products in a conveying direction comprise one from a group consisting of: a pair of rollers, a pair of rolls, a pair of belts, a combination of roll and belt, or a combination of roller and belt.

17. The method according to claim 5, wherein step (a) further comprises driving the first material surface such that the first material surface moves with a predetermined velocity relative to the product; and step (b) further comprises reducing the gap width until a driving force necessitated for driving the first material surface reaches a predetermined value.

18. The method according to claim 1, further comprising: reducing the gap width; and performing at least one step from a group of steps consisting of: i) stopping the reducing of the gap width responsive to the retardation of the driving action fulfilling the predetermined condition, and ii) continuing to reduce the gap width responsive to the retardation of the driving action not fulfilling the predetermined condition.

19. A computer program product for adjusting a gap between a first material surface and a second material surface, through which a product is to be conveyed, the computer program product comprising program code that, when run on a computer causes the computer to perform the following steps:

(a) exerting a driving action working towards a relative motion between the first material surface and the product to be conveyed in the gap, such that the driving action leaves a gap width between the first material surface and the second material surface unchanged;

(b) determining at which gap width a retardation counteracting the relative motion between the first material surface and the product to be conveyed fulfills a predetermined condition; and (c) adjusting the gap width to the determined width at which the retardation fulfills the predetermined condition.

20. A control circuit for adjusting a gap between a first material surface and a second material surface through which a product is to be conveyed, wherein the control circuit is configured for performing a method for adjusting a gap between a first material surface and a second material surface, through which a product is to be conveyed, the method comprising:

(a) exerting a driving action working towards a relative motion between the first material surface and the product to be conveyed in the gap, such that the driving action leaves a gap width between the first material surface and the second material surface unchanged;

(b) determining at which gap width a retardation counteracting the relative motion between the first material surface and the product to be conveyed fulfills a predetermined condition; and (c) adjusting the gap width to the determined width at which the retardation fulfills the predetermined condition.

21. A control circuit for adjusting a gap between a first material surface and a second material surface through which a product is to be conveyed, wherein the control circuit is configured for performing a method for adjusting a gap between a first material surface and a second material surface through which a product is to be conveyed, the method comprising:

(a) providing the product to be conveyed, the product being located in the gap between the first material surface and the second material surface, with a driving action working towards a relative motion between the first material surface and the product; and (b) changing the gap width, wherein the product is located in the gap, until a retardation counteracting a relative motion between the first material surface and the product fulfills a predetermined condition.

22. A paper-handling apparatus comprising a control circuit for adjusting a gap between a first material surface and a second material surface through which a product is to be conveyed, wherein the control circuit is configured for performing a method for adjusting a gap between a first material surface and a second material surface, through which a product is to be conveyed, the method comprising:

(a) exerting a driving action working towards a relative motion between the first material surface and the product to be conveyed in the gap, such that the driving action leaves a gap width between the first material surface and the second material surface unchanged;

(b) determining at which gap width a retardation counteracting the relative motion between the first material surface and the product to be conveyed fulfills a predetermined condition; and (c) adjusting the gap width to the determined width at which the retardation fulfills the predetermined condition.

23. A paper-handling apparatus comprising a control circuit for adjusting a gap between a first material surface and a second material surface through which a product is to be conveyed, wherein the control circuit is configured for performing a method for adjusting a gap between a first material surface and a second material surface through which a product is to be conveyed, the method comprising:

(a) providing the product to be conveyed, the product being located in the gap between the first material surface and the second material surface, with a driving action working towards a relative motion between the first material surface and the product; and (b) changing the gap width, wherein the product is located in the gap, until a retardation counteracting a relative motion between the first material surface and the product fulfills a predetermined condition.

* * * * *